US006945881B2

(12) United States Patent
Bates

(10) Patent No.: US 6,945,881 B2
(45) Date of Patent: Sep. 20, 2005

(54) CURVED BALL COURT

(75) Inventor: Farrell Christopher Bates, 639 N. Vickers St., Thunder Bay, Ontario (CA), P7C 4B6

(73) Assignee: Farrell Christopher Bates, Thunder Bay (CA)

( * ) Notice: Subject to any disclaimer, the term of this patent is extended or adjusted under 35 U.S.C. 154(b) by 10 days.

(21) Appl. No.: 10/401,697

(22) Filed: Mar. 31, 2003

(65) Prior Publication Data

US 2004/0029654 A1 Feb. 12, 2004

(30) Foreign Application Priority Data

Apr. 5, 2002 (CA) ..... 2380722

(51) Int. Cl.[7] ..... A63B 69/00
(52) U.S. Cl. ..... 473/415; 473/422; 473/434; 473/435
(58) Field of Search ..... 473/415, 434, 473/267, 422, 474, 476, 435, 446; 273/342, 118 R, 121 R; 472/88–90; 14/69.5; D21/817

(56) References Cited

U.S. PATENT DOCUMENTS 1,658,097 A * 2/1928 Pierce ..... 273/395
1,945,798 A * 2/1934 Barry ..... 273/121 R
4,407,501 A * 10/1983 Bates ..... 273/118 R
4,478,420 A * 10/1984 Sowards ..... 473/435
5,484,147 A * 1/1996 Fagan ..... 473/446
6,213,900 B1 * 4/2001 Steyn et al. ..... 473/434
6,215,390 B1 * 4/2001 Lin ..... 340/323 R

FOREIGN PATENT DOCUMENTS

| | | | | |
|---|---|---|---|---|
| CA | 1147766 | | 6/1983 | |
| DE | 3106135 | A1 * | 9/1982 | ..... A63B/69/00 |
| DE | 10105320 | A1 * | 9/2001 | ..... A63B/69/00 |
| GB | 2289422 | A * | 11/1995 | ..... A63B/63/00 |
| WO | WO 176698 | A1 * | 10/2001 | ..... A63B/69/00 |

* cited by examiner

*Primary Examiner*—Mitra Aryanpour
(74) *Attorney, Agent, or Firm*—Dennis R. Haszko; Borden Ladner; Borden Ladner Gervais LLP

(57) ABSTRACT

The invention relates to a ball court that allows persons with limited mobility to play a ball game while enjoying making challenging shots. One embodiment comprises an automatic score board. The court has a raised central portion that extends from the back wall to mid-court, tapering horizontally, narrowing away from the front wall. On either side of the central portion are strike zones sloping upward which merge into the back wall. As a player strikes a ball with a club, the ball travels along the player's strike zone and up the back wall. Momentum carries the ball across the wall and gravity draws it to the opponent's strike zone. The flattened parabolic curve allows a player to make a variety of shots that will enter the opponent's strike zone at different positions and angles. Upstanding peripheral walls with deflectors may be included on the court to allow a ball to travel challenging trajectories through the opponent's strike zone.

7 Claims, 9 Drawing Sheets

LOOP PROGRAM

```
10 P. '2Loop.txt'
20 B.179=0 : B.178=1 : B.147=0 : B.146=0
30 G.50
40 B.179=1 : B.178=0 : B.147=0 : B.146=0
50 IF B.150=0 G.200
60 G.250
70 B.179=0 : B.178=1 : B.147=0 : B.146=0
80 G. 100
90 B.179=1 : B.178=0 : B.147=0 : B.146=0
100 IF B.151=0 G.250
200 IF B.149 + B.150 =0 G.340
210 IF B.181=0 G.310
220 IF B.180=0 G.330
230 P. 'B CYCLE'
240 IF B.150=0 G.200
250 IF B.149 + B.151=0 G.400
260 IF B.181=0 G.310
270 IF B.180=0 G.330
280 P. 'C CYCLE'
290 IF B.151=0 G.250
300 G.50
310 IF B. 179=0 G.400
320 G.340
330 IF B.178=0 G.400
340 FOR X = 0 TO 22
350 B.146=1
360 NEXT X
370 B.146=0
380 IF B.179=0 G.40
390 G.20
400 FOR X = 0 TO 22
410 B.147=1
420 NEXT X
430 B.147=0
440 IF B.179=0 G.90
450 G.70
999 END
```

FIG. 17

CURVED BALL COURT

This application is entitled to the benefit of and claims priority from Canadian Patent Application 2,380,722 filed Apr. 5, 2002, the entirety of which is herein incorporated by reference.

FIELD OF THE INVENTION

This invention relates to a curved ball court particularly one on which a game can be played by two players without requiring the players to move from a set position.

BACKGROUND OF THE INVENTION

There are many ball games presently played on a court by all ages of players, these being ball games such as squash, tennis, hand ball and the like. All of these games have in common the fact that it is necessary for the players to move around on the court usually quite quickly in order to play the game. The playing of these games is therefore limited to persons who are completely mobile and any person having a disability associated with one of their legs is not able to play this type of ball game or is limited to playing a very poor game.

Canadian Patent No. 1,147,766 to F. C. Bates describes a ball court which is shaped such that two players can play a ball game without moving from a set position on the court. Players aim at a moving target along the back wall of the court, which is tethered by a rod to a central part of the court disposed between the two players. The court is arranged so that a ball hit from one side towards a curved end follows a path such that it arrives at the other side of the court passing close to the other player. Such a ball game can, therefore, be played without the players moving their feet and yet the thrill of playing a ball game and the exercise of playing the game are still achievable. The ball court presents a narrow strike zone parallel to the swing-track of the players regardless of the trajectory of the ball prior to entering the hitting area. A disadvantage of this ball court is that the parabolic shape of the rear wall ensures the arrival of the ball in the strike zone of an opponent. Players, therefore, find it easy to return the shot of their opponents and players are not as greatly challenged as they might be since they are not required to adjust their swing to compensate for variations in their opponent's shots.

SUMMARY OF THE INVENTION

Accordingly, it is an object of the present invention to mitigate or obviate at least one disadvantage associated with known ball courts. In particular, it is an object of the present invention to provide a ball court that permits a player to remain substantially stationary while providing challenging ball trajectories.

In summary, the ball court of this invention has a curved surface and is somewhat rectangular plan view. The front end of the court is flat and rises along a parabolic incline to a flattened concave shape at the back end, the front end of the court having a raised central region and concave sides extending downwardly from both sides of the raised central region. Side wall deflectors are provided to allow a player to provide unique ball trajectories and movement through the opponent's strike zone. A player stands at either side of the raised central region outside the edges of the court. A club somewhat similar to a golf club is used for propelling the ball from one end of the court up the parabolic incline to the opposite end and down to the other side of the court from whence it is returned by the other player.

In order to make the game more challenging, another embodiment of the court utilizes stationary targets on the back wall. The player hits a ball so that it will pass between the target and the wall and in doing so can be counted as a score in a game. A sensor is preferably associated with the target with signals being fed back through to a scoreboard so that every time a ball passes beneath a target a point will be recorded on the scoreboard.

In a first aspect, the present invention provides a curved ball court comprising a raised portion extending from a front region toward a central region. A concave playing surface is located at each side of the raised portion, and a vertical curved back wall extends between two upstanding peripheral side walls. The back wall has a modified parabolic profile when viewed from above, which enables a ball travelling along the back wall to deviate from a parabolic trajectory. The back wall merges the concave playing surfaces.

The court according to the invention can be modified in parabolic profile in any number of ways, such as by flattening the parabolic shape either completely or in part. In one example of modification, the flattening of the parabolic shape extends for substantially 25% of the distance between the side walls, and is centred at a mid-point of the back wall. A flattened region of from 10% to 60% of this distance may be incorporated in the parabolic profile of the back wall of the court.

The upstanding peripheral side walls of the court optionally have deflectors disposed thereon which deflecting the ball back inward, toward a concave playing surface. In this way, a ball travelling on a trajectory which is directed out of the court is prevented from leaving the court through deflection.

Optionally, a target may be present which is adjacent to and spaced apart from the back wall of the court. As a further option, the court may include a scoreboard for indicating the score of each player. Points and penalties may be assessed to either player, and displayed on the scoreboard. Points are accumulated when the ball passes between the target and the back wall. The target may alternately display one of two different colours to indicate which player's turn it is to score. A touch switch for each player may be incorporated into the invention, as described in more detail below.

An advantage of the present invention is an increase in the challenge associated with the game. In addition, there is greater opportunity to exhibit skill in the game by making relatively difficult shots using the side wall deflectors. This advantage is realized by the flattening or other modification of the parabolic shape of the back wall. Because of the modified shape of the back wall, the trajectory of the ball is influenced to a larger extent by the speed of the ball or by the spin imparted on the ball, instead of being influenced primarily by the shape of the back wall.

An advantage of the optional embodiment of the invention having alternating coloured targets is that there are fewer moving parts to the court, compared to courts having moving targets. Further, with fewer moving parts, the probability of breakage is reduced, and maintenance costs can be reduced.

Other aspects and features of the present invention will become apparent to those of ordinary skill in the art upon review of the following description of specific embodiments of the invention in conjunction with the accompanying drawings.

BRIEF DESCRIPTION OF THE DRAWINGS

The invention will now be described with reference to the accompanying drawings in which:

FIG. 17 illustrates an example Basic code for use with the system of the ball court.

DETAILED DESCRIPTION

Generally, the present invention provides a curved ball court that offers the excitement of a court based ball game without requiring that the player be able to move rapidly on his or her feet.

Figure 1:
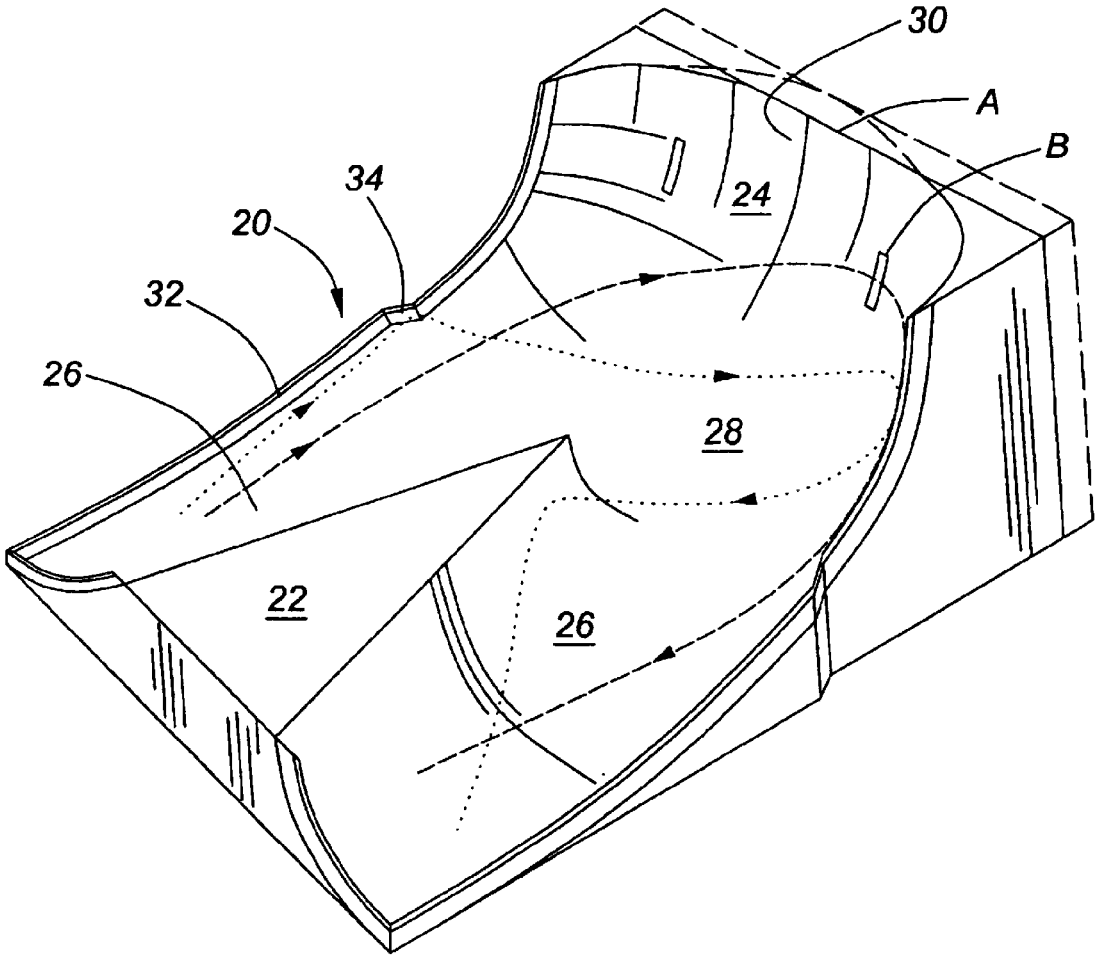
FIG. 1 is a perspective view of a ball court according to an embodiment of the present invention.

FIG. 1 illustrates a ball court 20 according to the invention, which has a raised central portion 22 that extends from the back wall 24 to mid-court and tapers horizontally, narrowing away from the back wall. On either side of the central portion are concave strike zones 26 which slope upward through a central playing area 28 and merge into an upwardly sloping back wall. Viewed from above, the profile of the back wall is a flattened parabolic curve 30. In other words, any horizontal plane taken through the back wall 24 and adjoining side walls forms two curved lines joined by a flat line and as can be clearly seen in FIG 1. As a player strikes a ball with a club, it travels along the player's strike zone through the central playing area and up the back wall where momentum carries the ball across the wall and gravity draws it to the opponent's strike zone. The flattened parabolic curve allows a player to make a variety of shots that will enter the opponent's strike zone at different positions and angles.

The two concave strike zones eventually merge into the flattened concave part 30 at the back of the court. The shape, however, from the front to the back of the court is a modified or deformed parabola. Hence a hard hit ball from the front of the court will quickly slow down when it reaches the back of the court while following a natural curve.

According to the present embodiment, along the sides of the ball court there are upstanding peripheral walls 32 which have side wall deflectors 34 comprising a portion of peripheral wall angled so as to form an irregularity or discontinuity allowing the player to send the ball on challenging trajectories through the opponent's strike zone. Portion "A" of FIG. 1 represents the top rim of the court, and portion "B" indicates a target region, at which a player makes effort to aim a ball.

Figure 2:
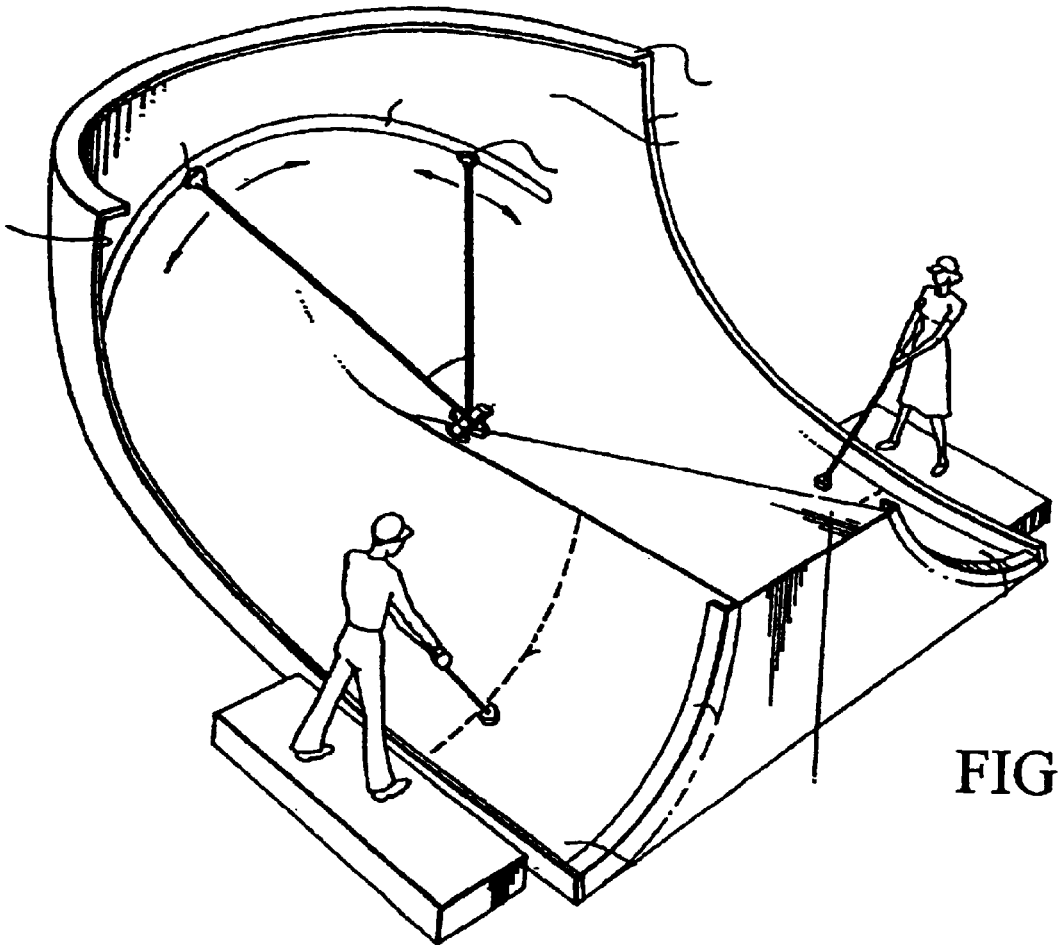
FIG. 2 PRIOR ART
FIG. 2 is a perspective view of a PRIOR ART curved ball court according to Canadian Patent No. 1,147,766.

FIG. 2 illustrates a PRIOR ART ball court according to Canadian Patent No. 1,147,766. In contrast with the PRIOR ART ball court which has a parabolic curve along the back wall (see FIG. 2), the curvature of the vertical central section of the back wall of the present invention is flattened (see FIG. 1). According to the present embodiment of the invention, the horizontal central curve 30 is flat for about 25% of the distance from the centre line to the outside edge. This enables a player to challenge his or her opponent by producing a variety of ball tracks through the opponent's striking area requiring the opponent to adjust his or swing to compensate for variations in the player's shots.

Figure 3:
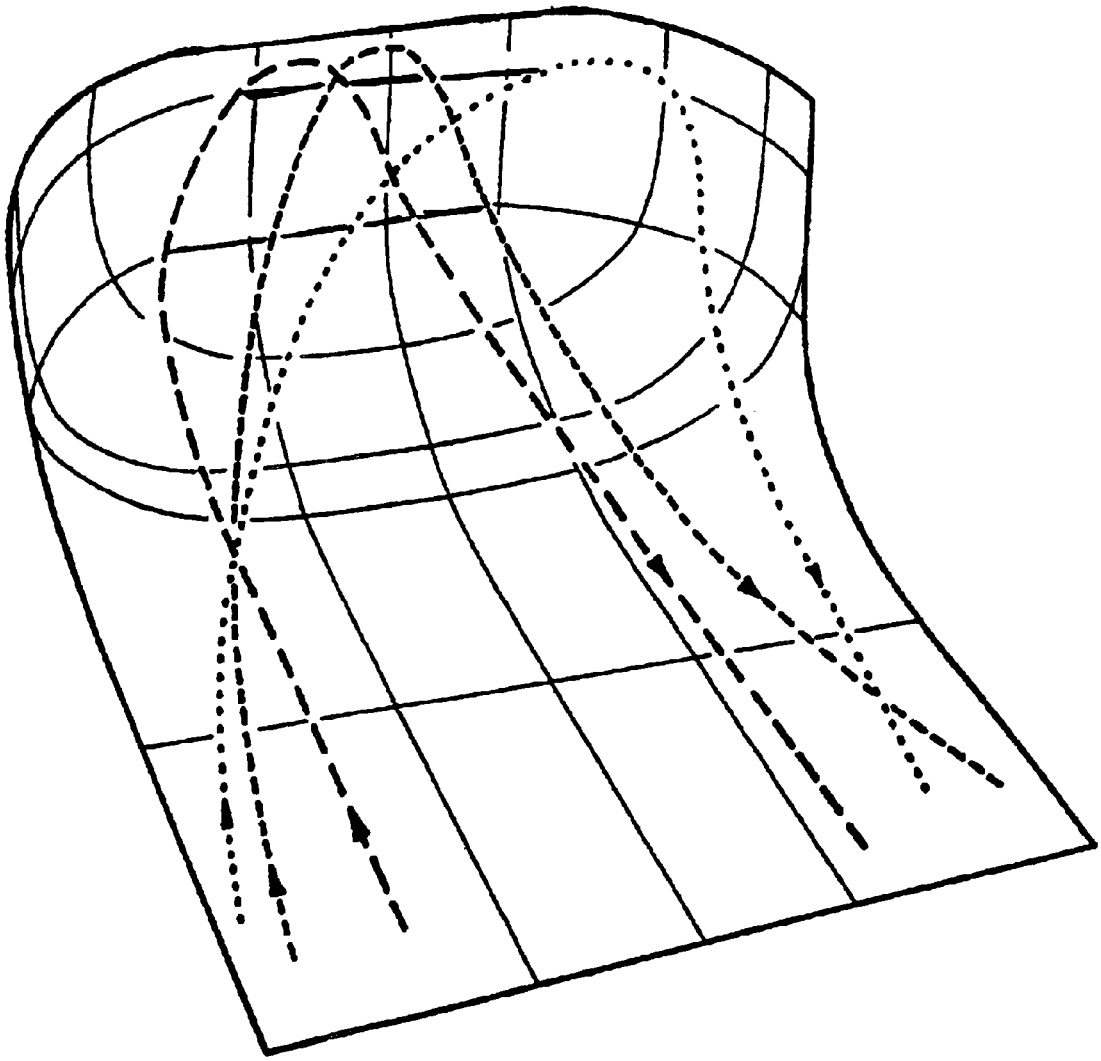
FIG. 3 illustrates three possible trajectories for a ball on the court according to the invention.

FIG. 3 illustrates three typical curve trajectories for a ball hit to the back of the court according to the invention. A ball hit on one side of the court, even if hit parallel to the edges of the court, will naturally curve over towards the other side of the court and run back along the other side of the court to the other player due to the shape of court. It is, therefore, not likely to have a ball hit from one side of the court return to that same side under its own momentum.

The ball court can be made from any suitable material such as wood planking, composite, or plastic sheeting on a wooden framework. However, it is preferable to build the court of concrete formed upon a wooden framework. This latter construction is preferred as it facilitates outdoor placement of the ball court.

Figure 4:
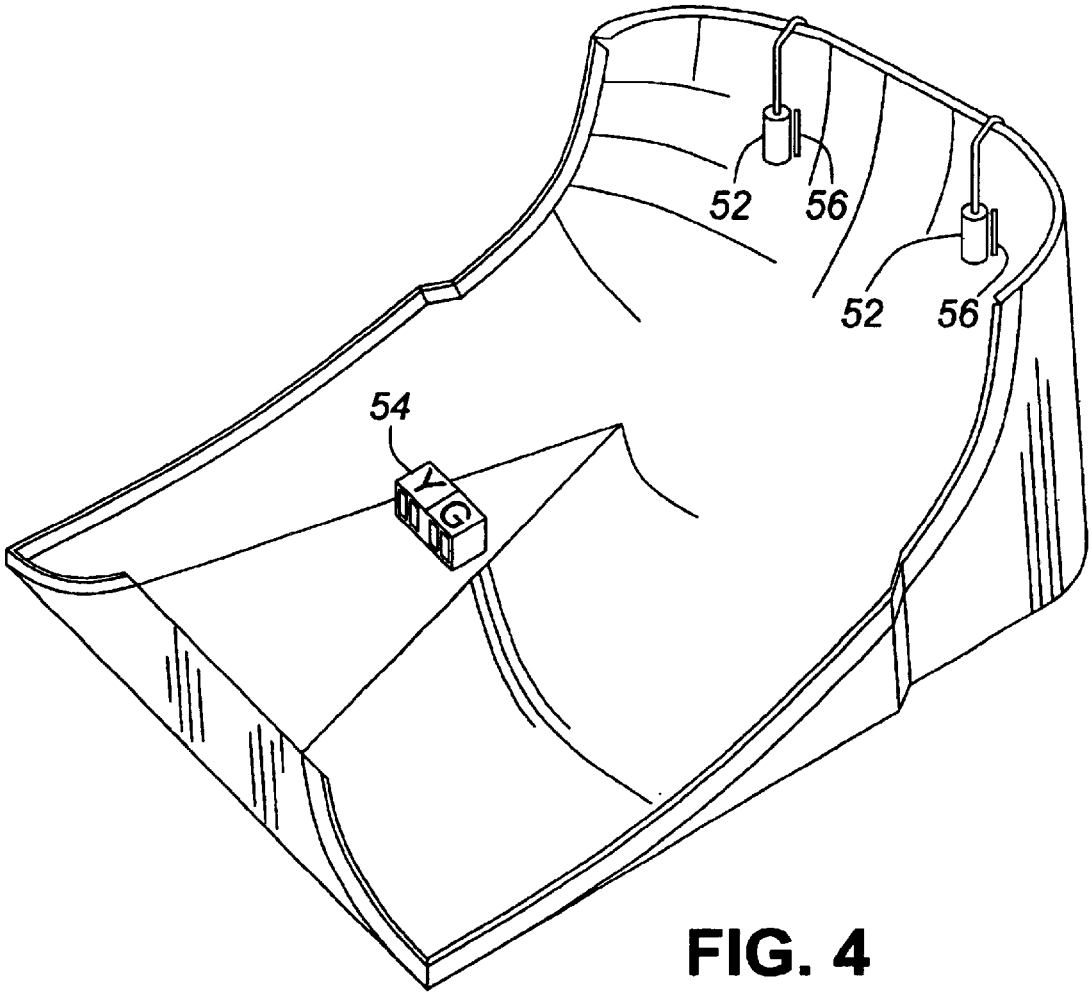
FIG. 4 is a perspective view of the ball court of FIG. 1 illustrating a system of targets and a scoreboard and their placement in the ball court.

FIG. 4 illustrates that the ball court may also be provided with a pair of targets 52 and a scoreboard 54. Each target is disposed in front of the infrared transmitter slot 56 by an amount that exceeds the ball diameter, so as to allow the ball to pass behind the target and over the slot.

Figure 5:
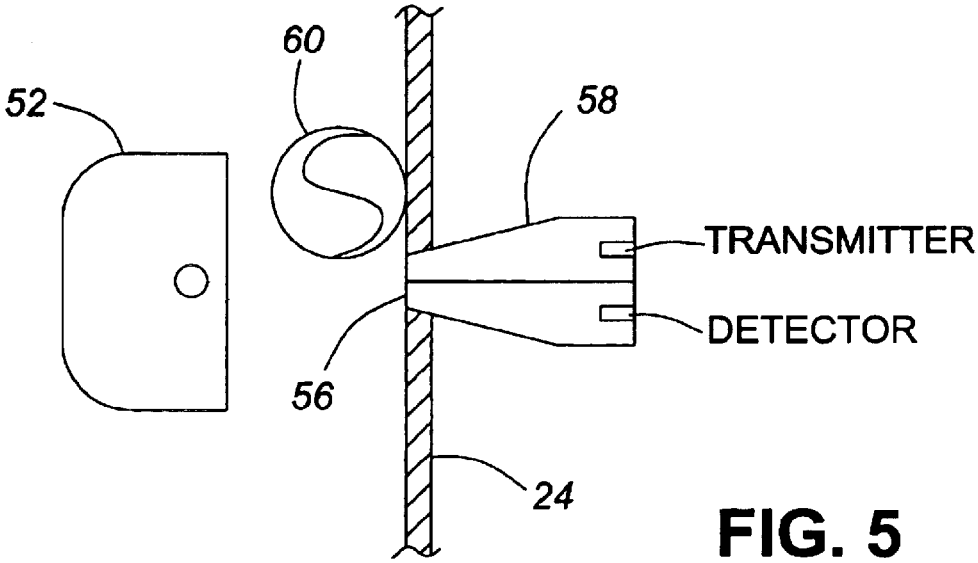
FIG. 5 is a partial sectional plan view of the back wall of the ball court of FIG. 4 illustrating the arrangement of the target, a transmitter and a detector.

FIG. 5 illustrates a plan view of a portion of the ball court at a point where the ball 60 passes in front of the slot 56, and behind the target 52. Each target is suspended from the back wall, adjacent and spaced from a slot 56 in the wall. An infrared transmitter and detector pair 58 are used to detect a ball 60 that passes over the slot and between the target and the wall. In this embodiment, each target is hung more than the ball diameter directly above the vertical. An infrared transmitter-detector window slot is found in the playing surface, so that the detector sees only "black" until the ball passes under the target and over the slot. The transmitters/detectors use a programmable logic device (not shown) that is controlled by software, an example of which is provided in FIG. 17 and discussed in detail below.

To play the game, each player is assigned a colour for scoring purposes. In the present example, one player is represented by the colour yellow and the other player by the colour green. Two targets are present on the court, one on each side corresponding to the positions of the players. Each target alternates in colour between green and yellow. A player can score only when the target displays his or her corresponding colour. At any given time during a game, one of the two targets displays the colour yellow, and the other target displays the colour green. Because the targets themselves change colour, an effect similar to having a "moving target" is accomplished in that a player must adjust his or her aim depending on which target displays the appropriate colour at the time of the shot. Further, this embodiment allows each player to adjust his or her aim for each shot, thereby avoiding repetition.

A player scores a point by hitting the ball toward the wall so as to allow passage of the ball behind the appropriate colour target, this is herein referred to as a "hit", or as "hitting" the target. Should a player hit a target while it displays the opponent's colour, the point is attributed to the opponent. Once a target is hit, a point is scored. After each point, the score is adjusted accordingly and displayed on the scoreboard. After a change is made on the scoreboard, each target changes colour.

In a variation of this embodiment, a touch switch for each player may be present on the curved ball court. When present, a touch switch is found in an accessible location, within reach of the club head for each player. The purpose of the touch switch is to enable a player to defend against an opponent who attempts to use the top rim of the curved ball court to rebound a high velocity ball through the defender's strike zone. A player may contact the touch switch when he anticipates that his opponent will be hitting the ball particularly hard, forcing the ball to travel along the top rim. In such a case, if the ball contacts the top rim, the player contacting the touch switch scores a point. However, if the ball does not contact the top rim, the touch switch has no effect on the score. The touch switch can also be used by a player to present a hazard to his opponent, should the opponent hit the ball along the top rim of the court by accident. If neither player anticipates that an opponent's ball will contact the top rim of the court, the touch switch may be ignored throughout the game.

When contacted by a player, the touch switch causes the scoring controller program to jump to a cycle that excludes the opposite touch switch, while maintaining the original features and functions of the controller program. Once a player ceases contact with the touch switch, the controller program will jump back to the original start up cycle. The first player to contact the touch switch has priority over the other player while the switch is contacted. As well as establishing this priority, the touch switch becomes one half of a digital logic AND GATE, the other half of which is a signal from a rim sensor, when contacted by the ball. Thus, to add a point to the score of the player to which the touch switch is dedicated, the touch switch must act in conjunction with the rim sensor. Neither the touch switch nor the rim sensor acting alone can effect a change in the score.

Figure 6:
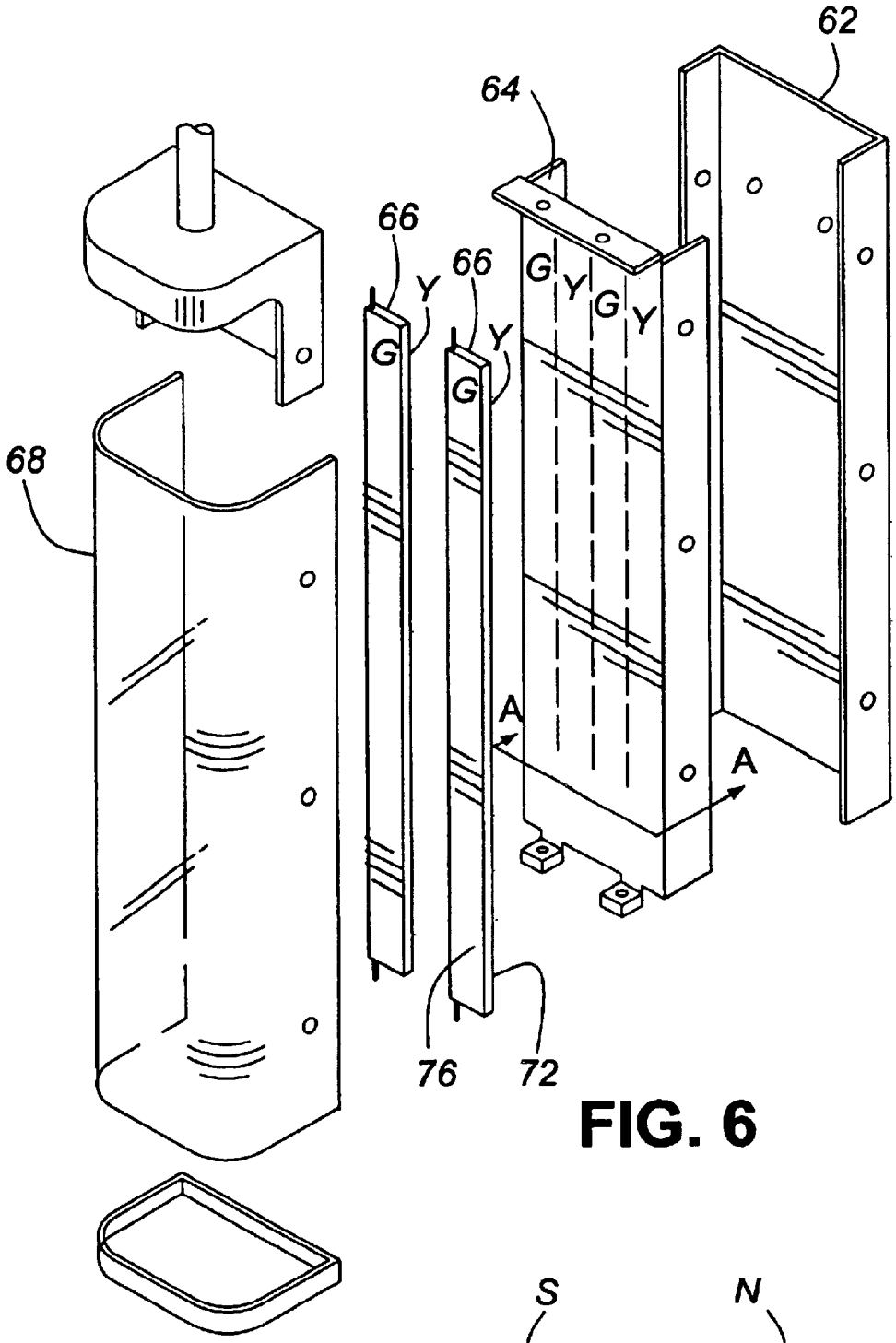
FIG. 6 is an exploded view of the target of FIG. 5.
Figure 7:
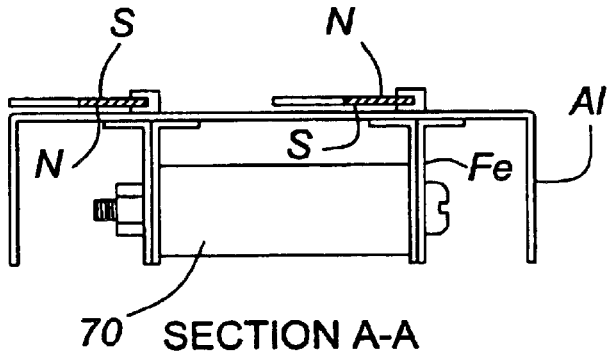
FIG. 7 is a sectional view along the line A—A in FIG. 6.

FIG. 6 illustrates an exploded view of an alternating colour target. FIG. 7 shows the alternating colour target of FIG. 6 in section, through the arrows indicated as A—A in FIG. 6. Referring to these figures, an exemplary target is generally composed of a non-reflective black surface 62, a green and yellow striped panel 64, pivoting strips 66 and a clear plastic cover 68. The pivoting strips are green on one side 76 and yellow on the other side 72. The strips and the panel are arranged such that when the pivoting strips are moved into a first position, the yellow portion of the striped panel is covered by the strips.

FIG. 7 illustrates a reversing electromagnet 70, as illustrated in pivots the strips between a first position and a second position. In the first position, the strips are oriented so that the yellow side 72 is exposed for viewing through the clear plastic cover and the green side 76 is adjacent to the yellow portion of the striped panel. In the second position each strip is oriented so that the green side is exposed for viewing, with the panel covering the yellow stripes. Accordingly, in the first position the target, as viewed through the clear plastic cover, appears to be yellow. When the reversing electromagnet causes the panel to pivot to the second position, the target, as viewed through the clear plastic cover, appears to be green. North and south portions of the reversing strips orient themselves appropriately, depending on the electromagnet. These actions are co-ordinated with other aspects of scoring by software, such as described below.

The scoreboard uses seven segment score board numbers. FIGS. 8 to 16 illustrate the details of the arrangement according to the present embodiment although other embodiments, including, for example, all electronic LED displays.

Figure 9:
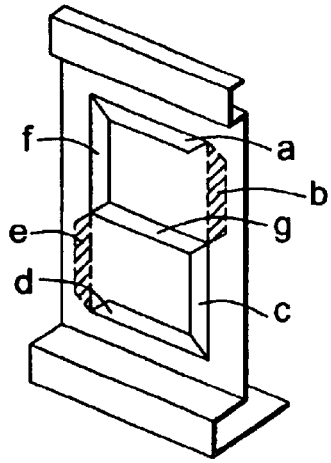
FIG. 9 is a view of a portion of the scoreboard of FIG. 5 illustrating the placement of the side segments.
Figure 14:
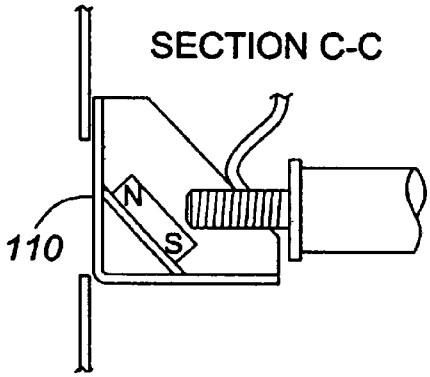
FIG. 14 is a sectional view along the line A—A of FIG. 13 illustrating the centre segment in a position to expose a black face.

Referring to FIGS. 9 and 14, each numeral of the display consists of seven segments labelled a to g as illustrated in FIG. 9. The seven numeral segments are changed by infra red detectors on the targets acting through an electronic logic circuit (not shown). The circuit is designed around a programmable logic device (not shown) that uses a Basic program.

Figure 8:
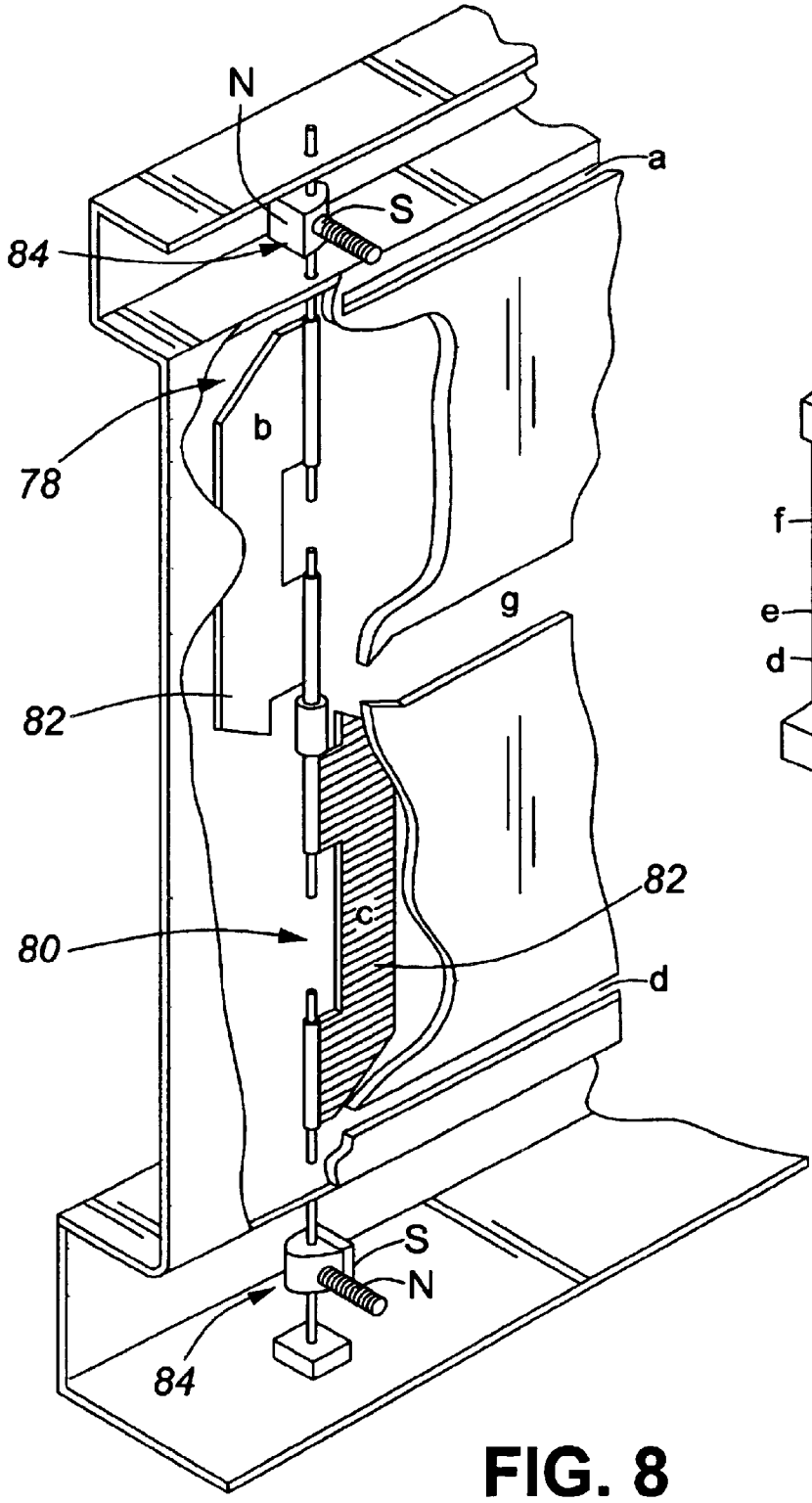
FIG. 8 is a partial exposed view of the scoreboard of FIG. 5 illustrating the side segments of the scoreboard.

The mechanism for numeral side segments b and c (78,80) are illustrated in a back-view in FIG. 8, with a similar mechanism being incorporated for segments e and f. Each of the segments comprises a pivotable flap 82 which is black on one side and white on the other. If the segment is to be visible, then it is pivoted so that the white side of the flap is exposed forming a contrast with the black face of the display. If the segment is not to be visible then it is pivoted so that the black side is exposed blending in with the black face of the display. A separate electromagnet 84 is used to pivot the flaps of each segment.

Figure 10:
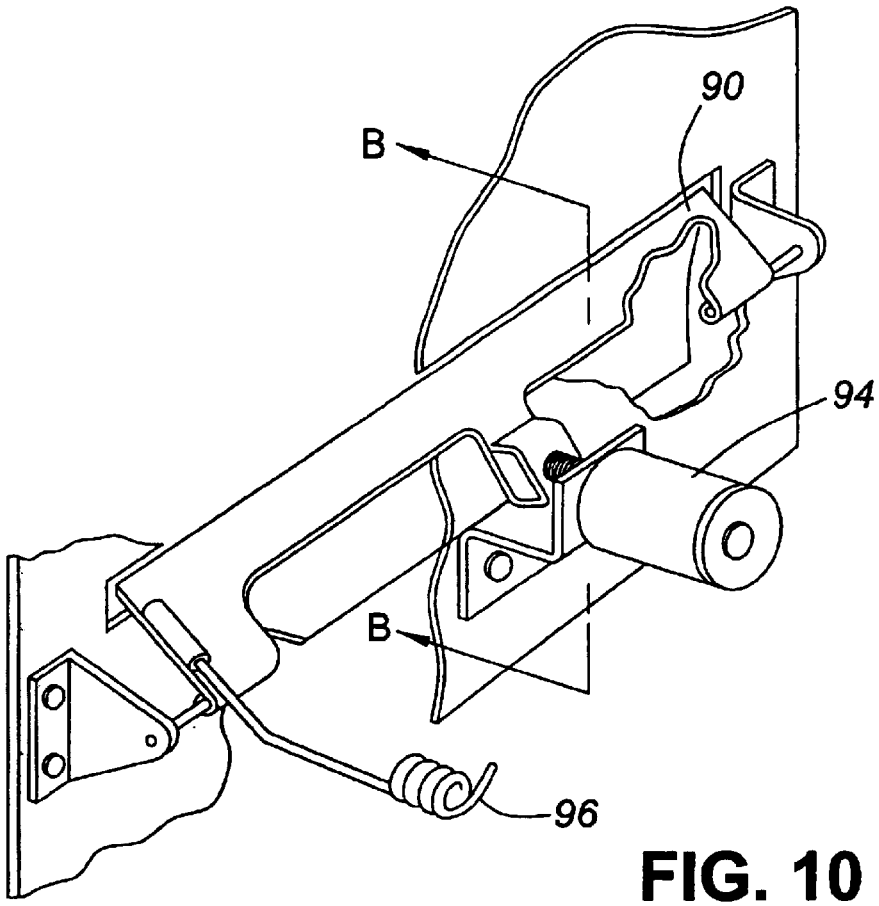
FIG. 10 is a detailed view of the top and bottom segments of the scoreboard of FIG. 5.
Figure 11:
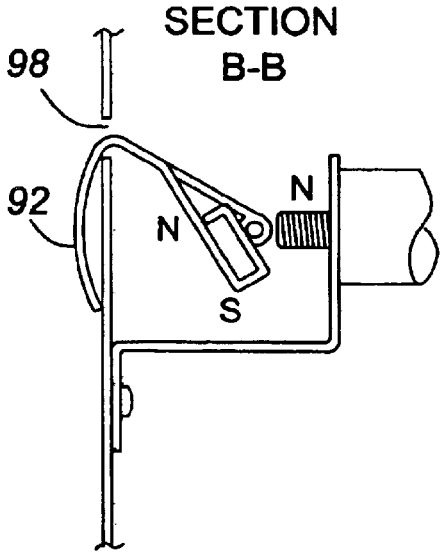
FIG. 11 is a section view along the line A—A of FIG. 10 illustrating a segment in a displayed position.
Figure 12:
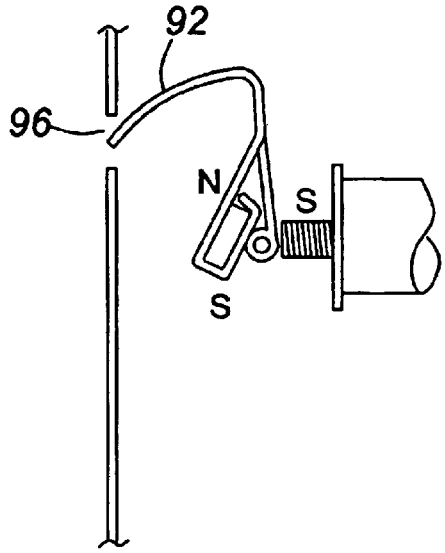
FIG. 12 is section view along the line A—A of FIG. 10 illustrating a segment a hidden position.

Referring to FIGS. 10 to 12, top segments a and d (86, 88) are similarly constructed. FIG. 10 shows a mechanism for movement of top and bottom segments. FIG. 11 shows a sectional view taken along section B—B of FIG. 10, with the segment displayed. FIG. 12 shows a similar view to FIG. 11, but with the segment hidden. A U-shaped member 90 having a white panel 92 is rotatable by means of a reversible electromagnet 94. A counterbalance 96 is used to aid in movement of the U-shaped member. When the segment is to be visible then the U-shaped member is rotated so that the white panel moves through a slot 98 in the face of the display 100 and forms a contrast with the black face of the display. When the segment is not to be visible, the U-shaped member is rotated so that the white panel is retracted from the slot exposing the black face of the display.

Figure 13:
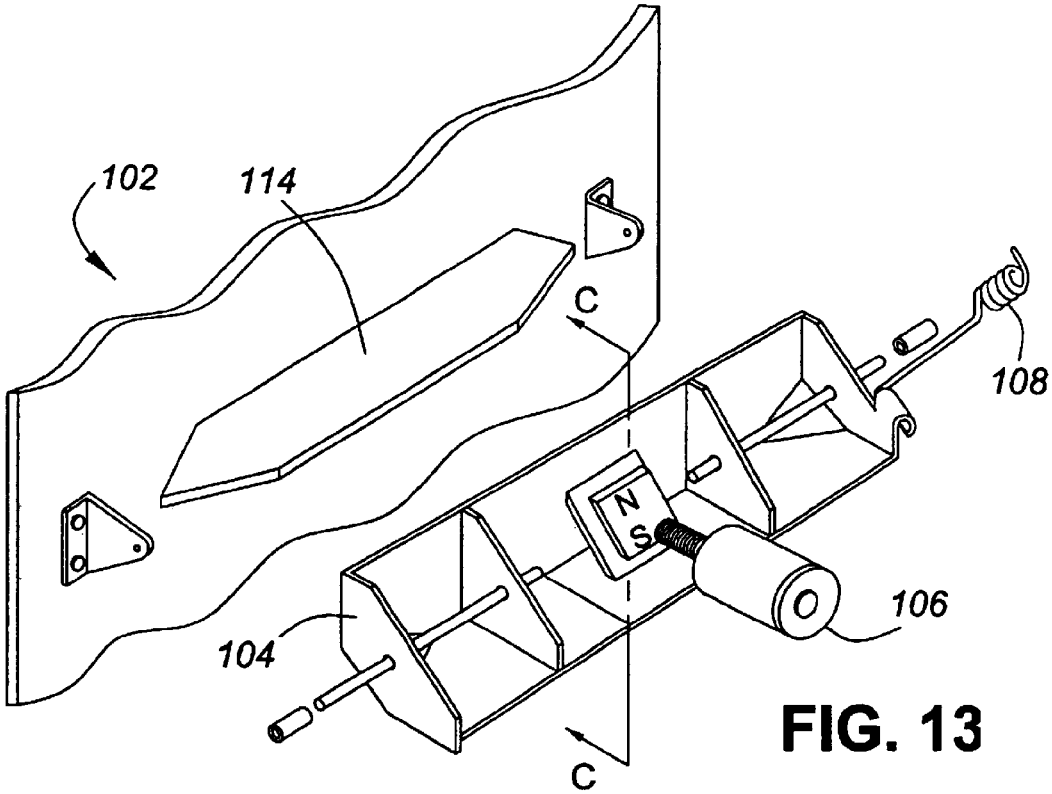
FIG. 13 is an exploded view of a centre segment.

FIG. 13 illustrates middle segment g (102), consisting of an elongated L-shaped member 104 pivoted by a reversible electromagnet 106 and assisted by a counterweight 108. One face 110 of the L-shaped member is black, another face 112 is white. When the segment is to be visible, the L-shaped member is pivoted so that the white face is exposed through a slot 114 in the face of the display. When the segment is not to be visible, the L-shaped member is pivoted so that the black face is exposed through the slot in the face.

Figure 15:
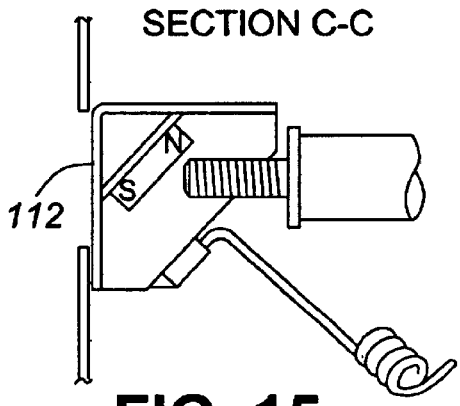
FIG. 15 is a sectional view along the line A—A of FIG. 13 illustrating the centre segment in a position to expose a white face.
Figure 16:
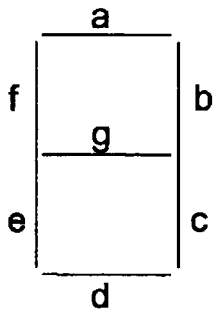
FIG. 16 is a schematic view illustrating the arrangement of segments of the scoreboard of FIG. 1.

FIG. 14 shows a sectional view taken through section C—C of FIG. 13, with the black face of the segment exposed. FIG. 15 shows a sectional view of taken through section C—C of FIG. 13, with the white face of the segment exposed. FIG. 16 schematically illustrates the numerical segments, similar to the depiction of FIG. 9.

In order to count the points obtained by a ball passing beneath a target, it is preferable that a sensing mechanism be situated adjacent each target to feed signals to a scoreboard displaying both players' scores. Such a sensing and scoring system will now be described.

With reference to FIG. 17, according to an embodiment of the present invention, we now describe a sensing and scoring system that includes a loop program. The program tallies the score, toggles the target colours and prioritizes the touch switches.

The Basic program given in FIG. 17 is designed to use an Electrically Erasable Programmable Logic Device (EEPLD) supplied by Blue Earth Research. The type in use is their Xplor 32 d, connected to a ST37 screw terminal module. The ports connecting to the controller through the terminals can be used for either input or output as called for by the Basic program.

The program uses a limited Basic Language called TBQ-comm to save space due to the limited memory capacity of the PLD. Memory space is also saved by using abbreviations for commands i.e. "B." for Bit, "G." for Go To, "IF" for If Then, "P." for Print, etc. The Print command in this program is used only to indicate the status of the program on the computer screen while the program is running and connected to the PLD during development. Once the program has been made bug-free, it can be uploaded to the PLD where it is permanent and independent of the computer. This program has been designed to be compatible with Windows 95.

To reduce confusion with the port address numbers, all of which are between 100 & 200, line numbers in this range not used in this program.

BITS 178 and 179 are used to make these ports outputs that cause target colour change. B.146 and B.147 are ports that output signals to the scoreboards. B.180 and B.181 are ports that input signals to the PLD controller from the detectors under each target. B.150 and B.151 input signals to the controller from the left and right touch switches. BIT 149 port signals hits on the rim.

The program labelled "2Loop.txt" runs in three different modes. Initially, on Run, the cursor sets the output ports to low "0" rather than the high "1" which is the normal start-up state. It then runs down to line 300 where it will continue to cycle back through lines 50 and 60 and 250 to 300 until redirected by a left or right target hit resulting in B.180 or 181 becoming 0.

In the next mode "C cycle" the cursor continues as in the first mode but with the Left touch switch closed, so that B.151 becomes 0. This arms the program to respond to a rim hit in favour of the L. scoreboard, while at the same time excluding any input from the right touch switch by skipping lines 50 and 60 and 300. That is, the cycle only uses lines 250 to 290.

The third mode of the program, "B cycle", results from the Right touch switch, B.150, being closed during any time that the Left touch switch is open, i.e. "high". When this occurs the cursor jumps from line 50 to line 200, drops through the program to line 240, then continues to cycle back to line 200 waiting for a target or rim hit. If the Right touch switch B.150 ceases to be held closed, the cursor will drop to line 250 where it will cycle in either the first or second mode as before.

If a rim hit occurs while in the B cycle, i.e. Right touch switch closed (line 200), the signal will go to the Green scoreboard through a Wait loop (lines 340 to 370) that holds the count signal High for a few seconds. This is to overcome any "switch bounce" that may occur that would result in more than a single increment in the score.

A rim hit while in the C cycle follows the same process as above through lines 250 and 400 to 430.

When a detector under either one of the targets sees a ball pass between it and the back side of the target, it will send a count signal through lines 310 to 330 to determine which colour it currently displays so that the count signal will go to the appropriate scoreboard through the debounce wait loop.

The debounce wait loop also makes it possible to see (on-off) LED blinks, when a system proving breadboard is connected to the controller, by prolonging the LED-off state.

Accordingly, the present invention creates a more interesting game by presenting players with the opportunity to make more interesting shots and to return more difficult shots having less predictable trajectories. In addition, the software and hardware of the target and scoreboard system affords an automatic and convenient way of keeping score without any effort by the players thereby increasing their ability to concentrate on the shot-making aspect of the game and increasing their general enjoyment of the activity.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A curved ball court for use by a pair of users, the court comprising a raised portion extending from a front region toward a central region, a concave playing surface at each side of the raised portion, a vertical curved back wall extending between two upstanding peripheral side walls, the vertical curved back wall having a modified parabolic profile including a flattened center section when viewed from above, the modified parabolic profile enabling a ball travelling between the users and along the vertical curved back wall to deviate from a parabolic trajectory, the vertical curved back wall merges the concave playing surfaces such that a contiguous contact surface for engaging the ball in a rolling manner is formed by the concave playing surfaces, the flattened center section and the two upstanding peripheral side wall wherein any horizontal plane taken through the back wall and adjoining side walls forms two curved lines joined by a flat line.

2. The court of claim 1, wherein the flattened center section extends for substantially 25% of the distance between the side walls, and is centred at a mid-point of the back wall.

3. The court of claim 1, wherein the upstanding peripheral side walls have deflectors for deflecting the ball toward a concave playing surface.

4. The court of claim 1, further comprising a target adjacent to and spaced apart from the back wall.

5. The court of claim 4, further comprising a scoreboard for indicating the score of a player as the player accumulates points by causing the ball to pass between the target and the back wall.

6. The court of claim 4, wherein the target alternately displays one of two different colours to indicate which player's turn it is to score.

7. The court of claim 4, further comprising a touch switch.

* * * * *